US007410356B2

(12) United States Patent
Higgins et al.

(10) Patent No.: US 7,410,356 B2
(45) Date of Patent: Aug. 12, 2008

(54) CIRCULATING FLUIDIZED BED BOILER HAVING IMPROVED REACTANT UTILIZATION

(75) Inventors: Brian S. Higgins, Walnut Creek, CA (US); Jay S. Crilley, Jackson Township, PA (US)

(73) Assignee: Mobotec USA, Inc., Orinda, CA (US)

( * ) Notice: Subject to any disclaimer, the term of this patent is extended or adjusted under 35 U.S.C. 154(b) by 268 days.

(21) Appl. No.: 11/281,915

(22) Filed: Nov. 17, 2005

(65) Prior Publication Data

US 2007/0119387 A1 May 31, 2007

(51) Int. Cl.
*F27B 15/10* (2006.01)

(52) U.S. Cl. ..... 432/17; 122/4 D; 165/104.16

(58) Field of Classification Search ..... 432/17, 432/15, 58; 165/104.16; 122/4 D
See application file for complete search history.

(56) References Cited

U.S. PATENT DOCUMENTS 4,154,581 A * 5/1979 Nack et al. ..... 48/197 R
4,469,050 A * 9/1984 Korenberg ..... 122/4 D
4,506,608 A * 3/1985 Strohmeyer, Jr. ..... 110/245
4,704,084 A * 11/1987 Liu et al. ..... 431/7
4,962,711 A * 10/1990 Yamauchi et al. ..... 110/347
5,345,883 A * 9/1994 Panos ..... 110/345
6,019,068 A * 2/2000 Tsuo et al. ..... 122/4 D
6,230,664 B1 * 5/2001 Janka et al. ..... 122/4 D
6,532,905 B2 * 3/2003 Belin et al. ..... 122/4 D

* cited by examiner

*Primary Examiner*—Gregory Wilson
(74) *Attorney, Agent, or Firm*—MacCord Mason PLLC

(57) ABSTRACT

A circulating fluidized bed boiler having improved reactant utilization. The circulating fluidized bed boiler includes a circulating fluidized bed having a dense bed portion; a lower furnace portion adjacent to the dense bed portion; and an upper furnace portion, wherein the dense bed portion of the circulating fluidized bed boiler is maintained below the stoichiometric ratio (fuel rich stage) and the lower furnace portion is maintained above the stoichiometric ratio (fuel lean stage), thereby reducing the formation of NOx.; a reactant to reduce the emission of at least one combustion product in the flue gas; and a plurality of secondary air injection ports downstream of the circulating fluidized bed for providing mixing of the reactant and the flue gas in the furnace above the dense bed, wherein the amount of reactant required for the reduction of the emission of the combustion product is reduced. In a preferred embodiment, the circulating fluidized bed boiler may further include a return system for returning carry over particles from the flue gas to the circulating fluidized bed.

36 Claims, 6 Drawing Sheets

CIRCULATING FLUIDIZED BED BOILER HAVING IMPROVED REACTANT UTILIZATION

BACKGROUND OF THE INVENTION (1) Field of the Invention

The present invention relates generally to a circulating fluidized bed boilers and, more particularly to a circulating fluidized bed boiler having improved reactant utilization for reduction of undesirable combustion products.

(2) Description of the Prior Art

The combustion of sulfur-containing carbonaceous compounds, especially coal, results in a combustion product gas containing unacceptably high levels of sulfur dioxide. Sulfur dioxide is a colorless gas, which is moderately soluble in water and aqueous liquids. It is formed primarily during the combustion of sulfur-containing fuel or waste. Once released to the atmosphere, sulfur dioxide reacts slowly to form sulfuric acid ($H_2SO_4$), inorganic sulfate compounds, and organic sulfate compounds. Atmospheric $SO_2$ or $H_2SO_4$ results in undesirable "acid rain."

According to the U.S. Environmental Protection Agency, acid rain causes acidification of lakes and streams and contributes to damage of trees at high elevations and many sensitive forest soils. In addition, acid rain accelerates the decay of building materials and paints, including irreplaceable buildings, statues, and sculptures. Prior to falling to the earth, $SO_2$ and NOx gases and their particulate matter derivatives, sulfates and nitrates, also contribute to visibility degradation and harm public health.

Air pollution control systems for sulfur dioxide removal generally rely on neutralization of the absorbed sulfur dioxide to an inorganic salt by alkali to prevent the sulfur from being emitted into the environment. The alkali for the reaction most frequently used include either calcitic or dolomitic limestone, slurry or dry quick and hydrated lime, and commercial and byproducts from Theodoric lime and trona magnesium hydroxide. The $SO_2$, once absorbed by limestone, is captured in the existing particle capture equipment such as an electrostatic precipitator or baghouse.

Circulating fluidized bed boilers (CFB) utilize a fluidized bed of coal ash and limestone or similar alkali to reduce $SO_2$ emissions. The bed may include other added particulate such as sand or refractory. Circulating fluidized bed boilers are effective at reducing $SO_2$ and NOx emissions. A 92% reduction in $SO_2$ emissions is typical, but can be as high as 98%. The molar ratio of Ca/S needed to achieve this reduction is designed to be approximately 2.2, which is 2.2 times the stoichiometric ratio of the reaction of calcium with sulfur. However, due to inefficient mixing, the Ca/S molar ratio often increases to 3.0 or more to achieve desired levels of $SO_2$ capture. The higher ratio of Ca/S requires more limestone to be utilized in the process, thereby increasing operating costs. Additionally, inefficient mixing results in the formation of combustion "hotspots" that promote the formation of NOx.

Thus, there exists a need for circulating fluidized bed boiler having improved reactant utilization for reduction of undesirable combustion products while, at the same time, may also reduce NOx formation.

SUMMARY OF THE INVENTION

The present invention is directed to a circulating fluidized bed boiler having improved reactant utilization. The circulating fluidized bed boiler may include a circulating fluidized bed. The circulating fluidized bed may include a dense bed portion, a lower furnace portion adjacent to the dense bed portion, and an upper furnace portion. The dense bed portion of the circulating fluidized bed boiler is preferably maintained below the stoichiometric ratio (fuel rich stage) and the lower furnace portion is preferably maintained above the stoichiometric ratio (fuel lean stage), thereby reducing the formation of NOx. The circulating fluidized bed boiler may also include a reactant to reduce the emission of at least one combustion product in the flue gas, a plurality of secondary air injection ports downstream of the circulating fluidized bed for providing mixing of the reactant and the flue gas in the furnace above the dense bed, wherein the amount of reactant required for the reduction of the emission of the combustion product is reduced, and a return system for returning carry over particles from the flue gas to the circulating fluidized bed.

In a preferred embodiment, the reactant is selected from the group consisting of: caustic, lime, limestone, fly ash, magnesium oxide, soda ash, sodium bicarbonate, sodium carbonate, double alkali, sodium alkali, and the calcite mineral group which includes calcite (CaCO3), gaspeite ({Ni, Mg, Fe}CO3), magnesite (MgCO3), otavite (CdCO3), rhodochrosite (MnCO3), siderite (FeCO3), smithsonite (ZnCO3), sphaerocobaltite (COCO3), and mixtures thereof. Preferably, the reactant is limestone.

In another embodiment, the secondary air injection ports are located in the lower furnace portion of the circulating fluidized bed boiler. The secondary air injection ports may be asymmetrically positioned with respect to one another. The secondary air injection ports may be arranged in a way selected from the group consisting of opposed inline, opposed staggered, and combinations thereof. Preferably, the secondary air injection ports are positioned between about 10 feet and 30 feet above the dense bed. The secondary air injection ports may be positioned at a height in the furnace wherein the ratio of the exit column density to the density of the dense bed top is greater than about 0.6. Also, the secondary air injection ports may be positioned at a height in the furnace wherein the gas and particle density is less than about 165% of the exit gas column density.

In a preferred embodiment, the jet penetration of each secondary air injection port, when unopposed, is greater than about 50% of the furnace width. The jet stagnation pressure may be greater than about 15 inches of water above the furnace pressure. Also, the jet stagnation pressure may be between about 15 inches and 40 inches of water above the furnace pressure. Preferably, the secondary air injection ports deliver between about 10% and 35% of the total air flow to the boiler.

In a preferred embodiment, the return system includes a separator for removing the carry over particles from the flue gas. The separator may be a cyclone separator. In an embodiment, the return system may also include a fines collector downstream from the separator. The fines collector may be a bag house or an electrostatic precipitator.

Accordingly, one aspect of the present invention is to provide a circulating fluidized bed boiler having improved reactant utilization. The circulating fluidized bed boiler includes: (a) a circulating fluidized bed including: a dense bed portion; a lower furnace portion adjacent to the dense bed portion; and an upper furnace portion; (b) a reactant to reduce the emission of at least one combustion product in the flue gas; and (c) a plurality of secondary air injection ports downstream of the circulating fluidized bed for providing mixing of the reactant and the flue gas in the furnace above the dense bed, wherein the amount of reactant required for the reduction of the emission of the combustion product is reduced.

Another aspect of the present invention is to provide a circulating fluidized bed boiler having improved reactant utilization. The circulating fluidized bed boiler includes: (a) a circulating fluidized bed including a dense bed portion, a lower furnace portion adjacent to the dense bed portion, and an upper furnace portion, wherein the dense bed portion of the circulating fluidized bed boiler is maintained below the stoichiometric ratio (fuel rich stage) and the lower furnace portion is maintained above the stoichiometric ratio (fuel lean stage), thereby reducing the formation of NOx; (b) a reactant to reduce the emission of at least one combustion product in the flue gas; and (c) a plurality of secondary air injection ports downstream of the circulating fluidized bed for providing mixing of the reactant and the flue gas in the furnace above the dense bed, wherein the amount of reactant required for the reduction of the emission of the combustion product is reduced.

Still another aspect of the present invention is to provide a circulating fluidized bed boiler having improved reactant utilization. The circulating fluidized bed boiler includes: (a) a circulating fluidized bed including: a dense bed portion; a lower furnace portion adjacent to the dense bed portion; and an upper furnace portion, wherein the dense bed portion of the circulating fluidized bed boiler is maintained below the stoichiometric ratio (fuel rich stage) and the lower furnace portion is maintained above the stoichiometric ratio (fuel lean stage), thereby reducing the formation of NOx; (b) a reactant to reduce the emission of at least one combustion product in the flue gas; (c) a plurality of secondary air injection ports downstream of the circulating fluidized bed for providing mixing of the reactant and the flue gas in the furnace above the dense bed, wherein the amount of reactant required for the reduction of the emission of the combustion product is reduced; and (d) a return system for returning carry over particles from the flue gas to the circulating fluidized bed.

These and other aspects of the present invention will become apparent to those skilled in the art after a reading of the following description of the preferred embodiment when considered with the drawings.

DESCRIPTION OF THE PREFERRED EMBODIMENTS

Figure 1:
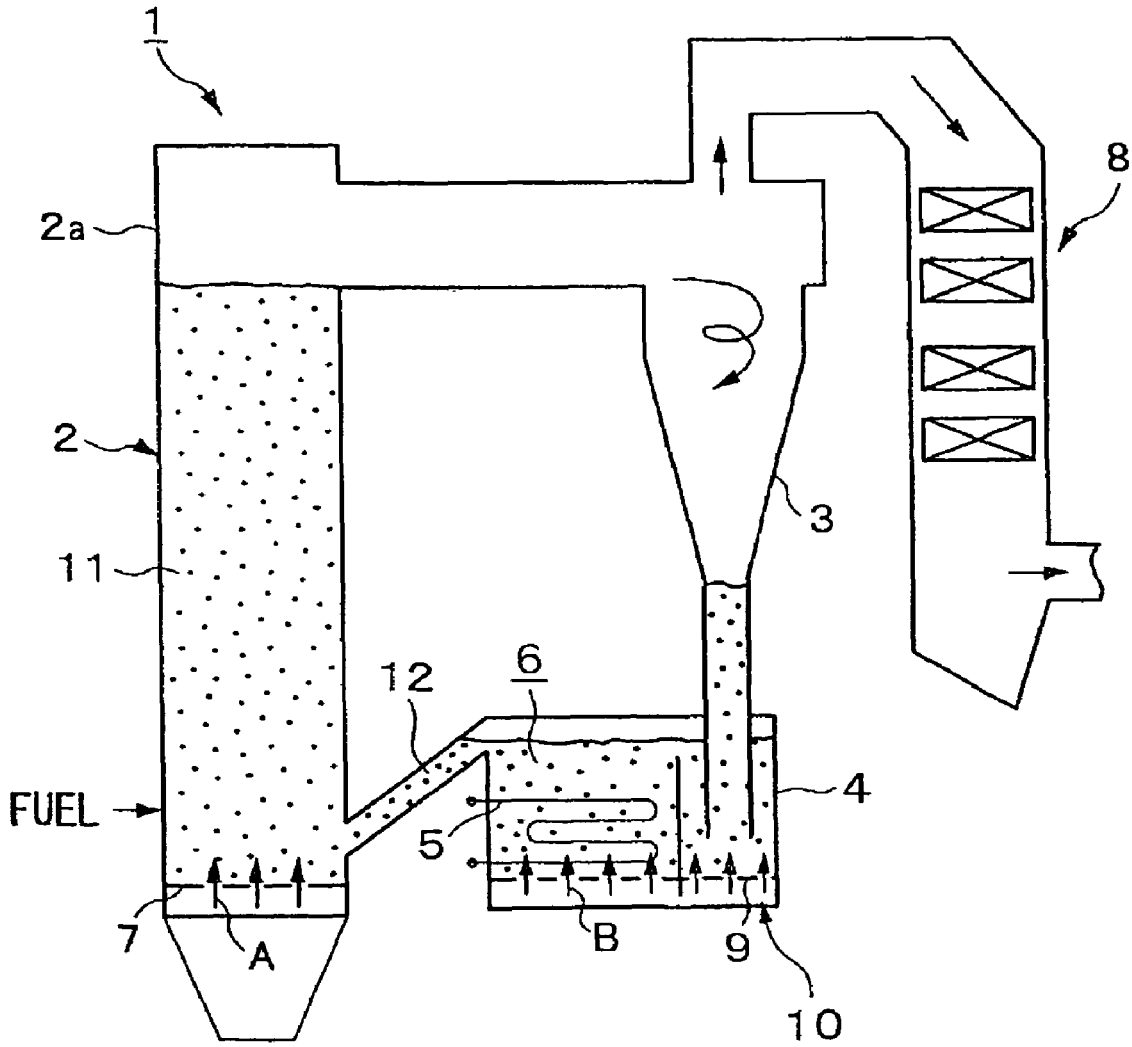
FIG. 1 (Prior Art)
FIG. 1 is an illustration of a prior art circulating fluidized bed boiler (CFB)

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. In the present invention, "reducible acid" refers to acids in which the acidity can be reduced or eliminated by the electrochemical reduction of the acid. In this description of the embodiment, the term "port" is used to describe a reagent injection passageway without any constriction on the end. The term "injector" is used to describe a reagent injection passageway with a constrictive orifice on the end. The orifice can be a hole or a nozzle. An injection device is a device that incorporates ducts, ports, injectors, or a combination thereof.

Referring now to the drawings in general, the illustrations are for the purpose of describing a preferred embodiment of the invention and are not intended to limit the invention thereto. As best seen in FIG. 1, a prior art embodiment of a conventional circulating fluidized bed boiler is shown, generally designated 1. The circulating fluidized bed boiler may include a furnace 2, a cyclone dust collector 3, a seal box 4, and an optional external heat exchanger 6. Flue gas, which is generated by the combustion in the furnace 2 flows into the cyclone dust collector 3. The cyclone dust collector 3 also separates particles from the flue gas. Particles which are caught by the cyclone dust collector 3 flow into the seal box 4. An external heat exchanger 6 performs heat exchange between the circulating particles and in-bed tubes in the heat exchanger 6.

In a preferred embodiment, the furnace 2 consists of a water cooled furnace wall 2*a* and air distribution nozzles 7. The air distribution nozzles 7 introduce fluidizing air A to the furnace 2 to create a fluidizing condition in the furnace 2, and are arranged in a bottom part of the furnace 2. The cyclone dust collector 3 is connected with an upper part of the furnace 2. An upper part of the cyclone dust collector 3 is connected with the heat recovery area 8 into which flue gas which is generated by the combustion in the furnace 2 flows, and a bottom part of the cyclone dust collector 3 is connected with the seal box 4 into which the caught particles flows. A super heater and economizer are contained in the heat recovery area 8.

An air box 10 is arranged in a bottom of the seal box 4 so as to intake upward fluidizing air B through an air distribution plate 9. The particles in the seal box 4 are introduced to the optional external heat exchanger 6 and are in-bed tube 5 under fluidizing condition.

In a conventional CFB boiler, there may be good mixing or kinetic energy in the lower furnace (i.e., in the dense bed). However, the present inventions are based on the discovery that there may be insufficient mixing in the upper furnace (i.e., above the dense bed) to more fully utilize the reactants added to reduce the emissions in the flue gases. As used herein, the top of the dense bed is generally where the gas and particle density is greater than about twice the boiler exit gas/particle density.

In the lower furnace, which is typically just in front of the coal feed port, volatile matter (gas phase) from the coal quickly mixes and reacts with available oxygen. This creates a low density, hot gaseous plume that is very buoyant relative to the surrounding particle laden flow. This buoyant plume quickly rises, forming a channel, chimney or plume from the lower furnace to the roof. Limestone, which absorbs and reduces the $SO_2$, is absent in the channel. After hitting the roof of the furnace, it has been discovered that this high $SO_2$ flue gas may exit the furnace and escape the cyclone without sufficient $SO_2$ reaction. Measurements of the furnace exit duct have shown nearly 10 times higher $SO_2$ concentrations in the upper portion of the exit duct relative to the bottom of the duct.

In the furnace of a conventional circulating fluidized bed boiler, bed materials 11 which comprise ash, sand, and/or limestone etc. are under suspension by the fluidizing condition. Most of the particles entrained with flue gas escape the furnace 2 and are caught by the cyclone dust collector 3 and are introduced to the seal box 4. The particles thus introduced to the seal box 4 are aerated by the fluidizing air B and are heat exchanged with the in-bed tubes 5 of the optional external heat exchanger 6 so as to be cooled. The particles are returned to the bottom of the furnace 2 through a duct 12 so as to re-circulate through the furnace 2.

In the present invention, high velocity mixing air injection is utilized above the dense bed to both reduce limestone usage and reduce the NOx emissions in a circulating fluidized bed boiler. Additionally, Hg and Acid gas emissions can be reduced. The high velocity mixing air injection above the dense bed provides a vigorous mixing of the fluidized bed space, resulting in greater combustion and reaction efficiencies, thereby reducing the amount of limestone or other basic reagent needed to neutralize the flue acids to acceptable levels.

Figure 2:
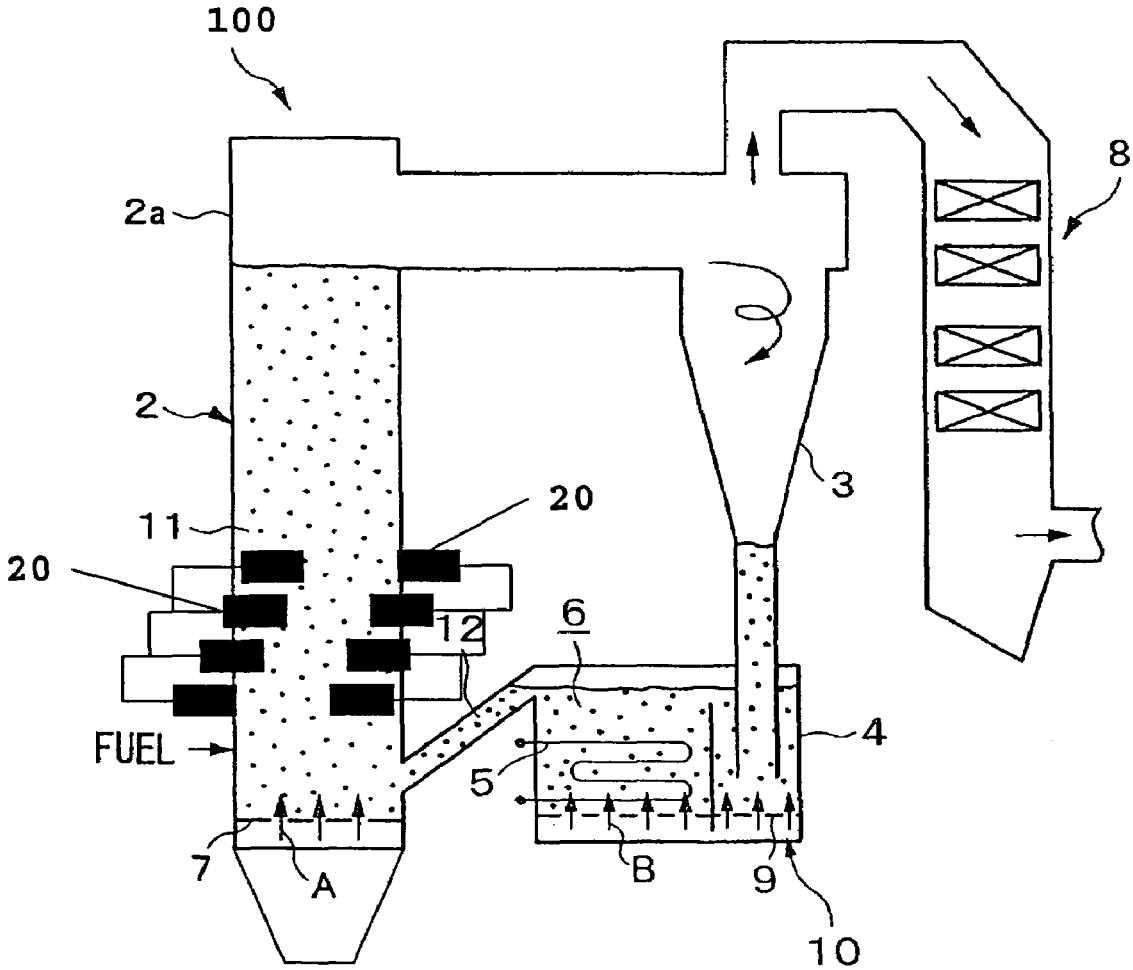
FIG. 2 is an illustration of a circulating fluidized bed boiler having improved limestone utilization constructed according to the present inventions.
Figure 3:
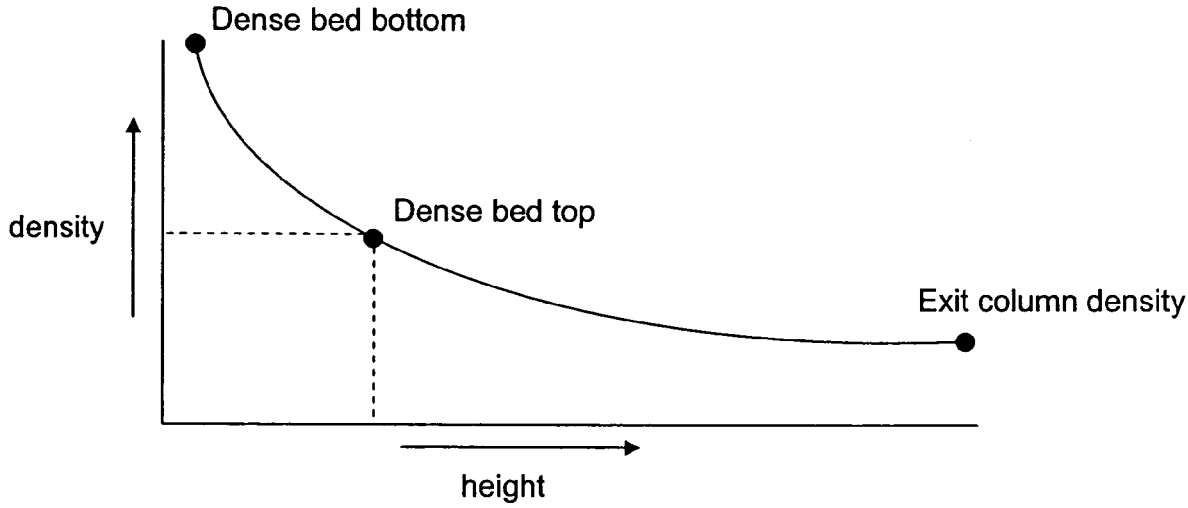
FIG. 3 is a graphical representation of the relationship of gas and particle density versus furnace height in the CFB.

In an embodiment of the present invention, generally described as 100 in FIG. 2, the circulating fluidized bed boiler of the present invention includes a series of secondary air injection ports 20 advecting the secondary air into the fluidized bed. Preferably, the ports are positioned in a predetermined, spaced-apart manner to create rotational flow of the fluidized bed zone. More preferably, the secondary air injection ports are spaced asymmetrically to generate rotation in the boiler. Since many boilers are wider than they are deep, in an embodiment, a user may set up two sets of nozzles to promote counter rotating.

In one embodiment of the present invention, the secondary air injection ports are positioned between about 10 feet and 30 feet above the dense bed. The air injection ports are preferably arranged to act at mutually separate levels or stages on the mutually opposing walls of the reactor. This system thus provides a vigorous mixing of the fluidized bed space, resulting in greater reaction efficiency between the $SO_2$ and limestone and thereby permitting the use of less limestone to achieve a given $SO_2$ reduction level. The enhanced mixing permits the reduction of the stoichiometric ratio of Ca/S to achieve the same level of $SO_2$ reduction.

The primary elements of high velocity mixing air injection above the dense bed design are:

(1) the location of the high velocity mixing air ports is well above the dense bed portion of the CFB where the dense bed is defined as the portion having a density greater than about twice the furnace exit (cyclone entrance) density, (2) the high velocity mixing air ports are preferably designed to give rotation of the flue gas, thus further increasing downstream mixing, and (3) the high velocity mixing air ports are high pressure air injection nozzles that introduce high velocity, high momentum, and high kinetic energy turbulent jet flow.

Similarly, the vigorous mixing produced by the present invention may also prevents channels or plumes and consequential lower residence time of sulfur compounds, thereby allowing them more time to react in the reactor and further increasing the reaction efficiency. The vigorous mixing also provides for more homogeneous combustion of fuel, thereby reducing "hot spots" in the boiler that can create NOx.

Preferably, the mass flow of air through the high velocity mixing air ports should introduce between about 15% and 40% of the total air flow. More preferably, the high velocity mixing air ports should introduce between about 20% and 30% of the total air flow.

In a preferred embodiment of the present invention, the exit velocities for the nozzles should be in excess of about 50 m/s. More preferably, the exit velocities should be in excess of about 100 m/s.

The air flow can be hot (drawn downstream of the air heater (air-side)), ambient (drawn upstream of the air heater (air side) at the FD fan outlet), or ambient (drawn from the ambient surrounding). Air that bypasses the air heater is much less expensive to install non-insulated duct work for, but the overall efficiency of the boiler suffers.

Prior art high-velocity over-fired air applications are limited to mixing combustion zones composed primarily of flue gases and therefore do not increase the efficiency of limestone usage. In the present invention, mixing is directed to the furnace combustion zone containing a large mass of inert particles, namely the coal ash and limestone particles. Further, the prior art utilizes staging for NOx reduction or high velocity jet mixing for chemical addition. In the present invention, staging may be used in addition to mixing and is used to increase the reaction time, control bed temperature control, and reduce the effects of "chimneys" in the furnace.

The present invention may be best understood after a review of the following examples:

EXAMPLE 1

FLUENT, a computational fluid dynamics analytic software program available from Fluent, Inc. of Lebanon, N.H., was used to model two-phase thermo-fluid phenomena in a CFB power plant. FLUENT solves for the velocity, temperature, and species concentrations fields for gas and particles in the furnace. Since the volume fraction of particle phase in a CFB is typically between about 0.1% and 0.3%, a granular model solving multiphase flow was applied to this case. In contrast to conventional pulverized-fuel combustion models, where the particle phase is solved by a discrete phase model in a granular model both gas phase and particle phase conservation equations are solved in an Eulerian reference frame.

The solved conservation equations included continuity, momentum, turbulence, and enthalpy for each phase. In this multi-phase model, the gas phase (>99.7% of the volume) is the primary phase, while the particle phases with its individual size and/or particle type are modeled as secondary phases. A volume fraction conservation equation was solved between the primary and secondary phases. A granular temperature equation accounting for kinetic energy of particle phase was solved, taking into account the kinetic energy loss due to strong particle interactions in a CFB. The present model took five days to converge to a steady solution, running on six CPUs in parallel.

While ash and limestone were treated in the particle phase, coal combustion was modeled in the gas phase. Coal was modeled as a gaseous volatile matter with an equivalent stoichiometric ratio and heat of combustion. The following two chemical reactions are considered in the CFB combustion system:

$$CH_{0.85}O_{0.14}N_{0.07}S_{0.02}+1.06O_2 \rightarrow 0.2CO+0.8CO_2+0.43H_2O+0.035N_2+0.02SO_2$$

$$CO+0.5O_2 \rightarrow CO_2$$

The chemical-kinetic combustion model included several gas species, including the major products of combustion: CO, $CO_2$, and $H_2O$. The species conservation equations for each gas species were solved. These conservation laws have been described and formulated extensively in computational fluid dynamics (CFD) textbooks. A k-ϵ turbulence model was implemented in the simulation, and incompressible flow was assumed for both baseline and invention cases.

All differential equations were solved in unsteady-state because of the unsteady-state hydrodynamic characteristics in the CFB boiler. Each equation was solved to the convergence criterion before the next time step is begun. After the solution was run through several hundred-time steps, and the solution was behaving in a "quasi" steady state manner, the time step was increased to speed up convergence. Usually the model was solved for more than thirty seconds of real time to achieve realistic results.

The CFD computational domain used for modeling is 100 feet high, 22 feet deep, and 44 feet wide. The furnace has primary air inlet through grid and 14 primary ports on all four walls. It also has 18 secondary ports, 8 of them with limestone injection, and 4 start-up burners on both front and back walls. Two coal feeders on the front wall convey the waste coal into the furnace. The other two coal feeders connect to each of the cyclone ducts after the loop seal. Two cyclones connecting to the furnace through two ducts at the top of the furnace collect the solid materials, mainly coal ash and limestone, and recycle back into the furnace at the bottom. The flue gas containing major combustion products and fly ash and fine reacted (and/or unreacted) limestone particles leaves the top of the cyclone and continue in the backpass. Water walls run from the top to the bottom of all four-side walls of the furnace. There were three stages of superheaters. The superheater I and II are in the furnace, whereas the superheater III is in the backpass.

The cyclone was not included in the CFB computational domain because the hydrodynamics of particle phase in the cyclone is too complex to practically include in the computation. The superheat pendants are included in the model to account for heat absorption and flow stratification, and are accurately depicted by the actual number of pendants in the furnace with the actual distance. Note that the furnace geometry was symmetric in width, so the computational domain only represents one half of the furnace. Consequently, the number of computational grid is only half, which reduced computational time.

Table 1 shows the baseline system operating conditions including key inputs for the model furnace CFD baseline simulations.

TABLE 1

| Parameter | Unit | Value |
|---|---|---|
| System load | $MW_{gross}$ | 122 |
| Net load | $MW_{net}$ | 109 |
| System firing rate | MMBtu/hr | 1226 |
| System excess $O_2$ | %-wet | 2.6 |
| System excess Air | % | 14.9 |
| System coal flow | kpph | 187 |
| Total air flow (TAF) | kpph | 1114 |
| Primary air flow rate through bed grid | kpph | 476 |
| Primary air flow rate through 14 ports | kpph | 182 |
| Primary air temperature | ° F. | 434 |
| Secondary air flow rate through 18 ports | kpph | 262 |
| Secondary air through 4 start-up burners | kpph | 104 |
| Secondary air through 4 coal feeders | kpph | 65 |

TABLE 1-continued

| Parameter | Unit | Value |
|---|---|---|
| Air flow rate through limestone injection | kpph | 11.5 |
| Air flow through loop seal | kpph | 12.8 |
| Secondary air temperature | ° F. | 401 |
| Limestone injection rate | kpph | 40 |
| Solid recirculation rate | kpph | 8800 |

Table 2 shows the coal composition of the baseline case.

TABLE 2

| Sample | | |
|---|---|---|
| Time | | |
| Proximate analysis | | |
| Volatiles Matter | [wt % ar] | 15.09 |
| Fixed Carbon | [wt % ar] | 35.06 |
| Ash | [wt % ar] | 42.50 |
| Moisture | [wt % ar] | 7.07 |
| HHV (Btu/lb) | [Btu/lb] | 6800.0 |
| Ultimate analysis | | |
| C | [wt % ar] | 41.0 |
| H | [wt % ar] | 2.1 |
| O | [wt % ar] | 1.2 |
| N | [wt % ar] | 3.5 |
| S | [wt % ar] | 2.63 |
| Ash | [wt % ar] | 42.5 |
| $H_2O$ | [wt % ar] | 7.07 |

In FLUENT, the coal is modeled as a gaseous fuel stream and a solid particle ash stream with the flow rates calculated from the total coal flow rate and coal analysis. The gaseous fuel is modeled as $CH_{0.85}O_{0.14}N_{0.07}S_{0.02}$ and is given a heat of combustion of $-3.47\times10^7$ J/kmol. This is equivalent to the elemental composition and the heating value of the coal in the tables.

In the following section, the baseline case results are compared to the invention case results.

High velocity injection significantly improves the mixing by relatively uniformly distributing air into the furnace. The mixing of the furnace can be quantified by a coefficient of variance (CoV), which is defined as standard deviation of $O_2$ mole fraction averaged over a cross section divided by the mean $O_2$ mole fraction. The Coefficient of Variance ($\sigma/\bar{x}$) in $O_2$ distribution for the baseline case and invention case over four horizontal planes are compared in Table 3. As can be seen, all four planes have high CoV in the baseline case with a range from 66% to 100%, but are significantly lower in both invention cases, indicating that the mixing is significantly improved.

TABLE 3

| Furnace Height [ft] | Baseline case | Invention case |
|---|---|---|
| 33 | 66% | 43% |
| 49 | 84% | 40% |
| 66 | 100% | 47% |
| 80 | 80% | 46% |

Figure 4:
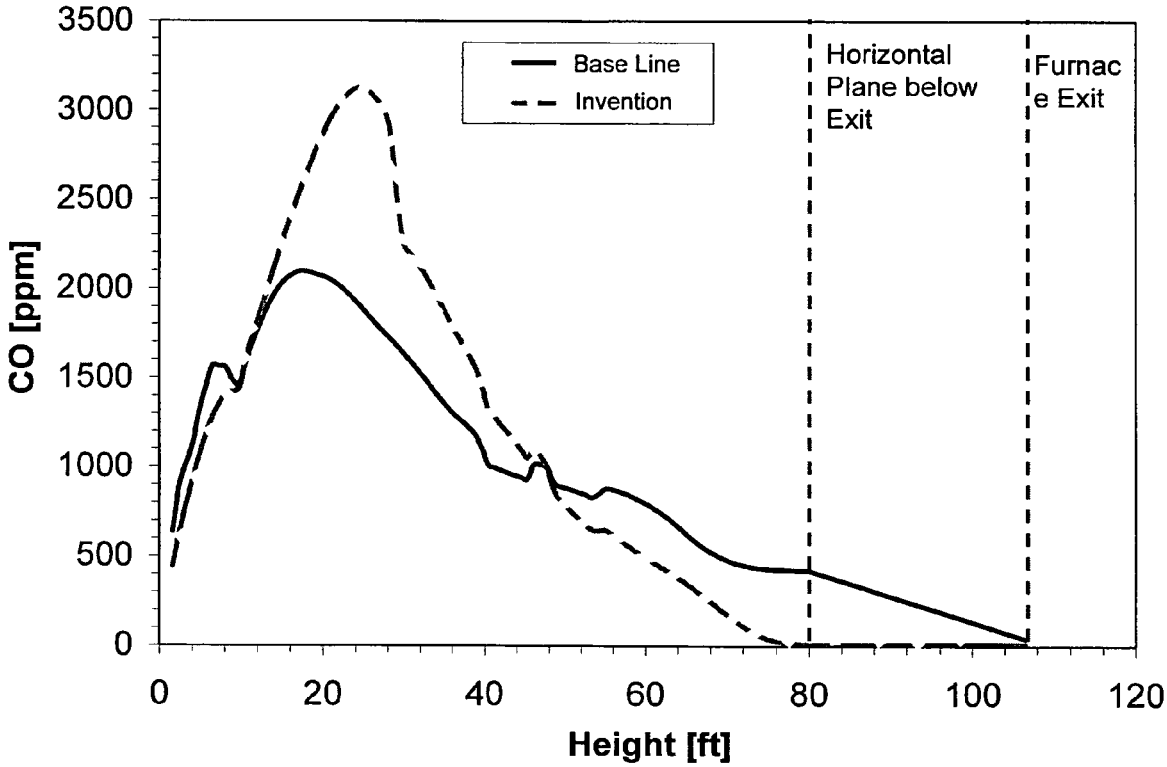
FIG. 4 is a graphical representation of the relationship of mass weighted CO versus height for the baseline case and the present invention case.

As best seen in FIG. 4, the mass weighted CO versus height for the baseline case and invention case is compared. Due to staging in the invention case, the CO concentration is higher than that in the baseline case in the low bed below the high velocity air ports. Above the high velocity air ports, the CO concentration rapidly decreases, and the furnace exit CO is even lower than that in the baseline case. The rapid reduction in CO indicates better and more complete mixing.

Figure 5:
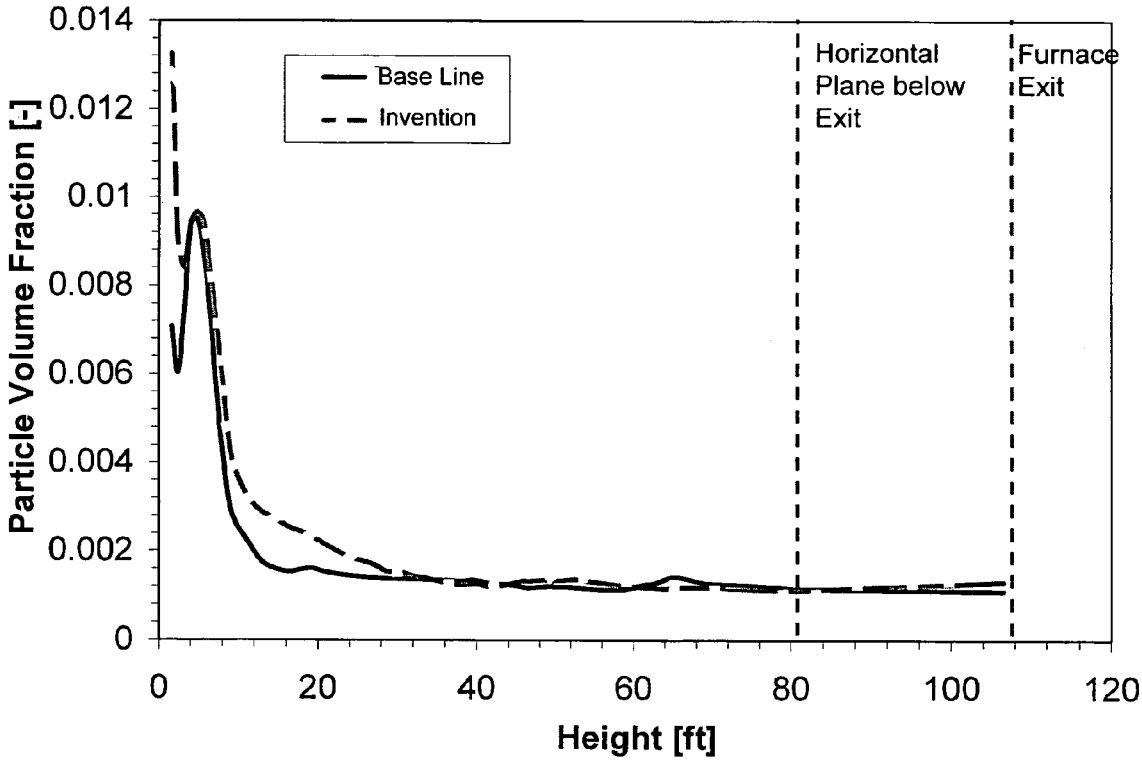
FIG. 5 is a graphical representation of the relationship of the mass-averaged particle volume fraction versus height for the baseline case and the present invention case.

The particle fraction distributions of the baseline case and the present invention case are shown in FIG. 5. The figure clearly shows the lower bed is more dense than the dilute upper bed. The solid volume fraction in the upper furnace is between 0.001 to 0.003. The distribution also reveals particle clusters in the bed, which is one of the typical features of particle movement in CFBs. The air and flue gas mixtures move upward through these clusters. Similar particle flow characteristics can be seen in the present invention case; however, it is also observed that the lower bed below the high velocity air injection is slightly denser than the baseline case, due to low total air flow in the lower bed. The upper bed in the present invention case shows similar particle volume fraction distribution to the baseline case.

Figure 6:
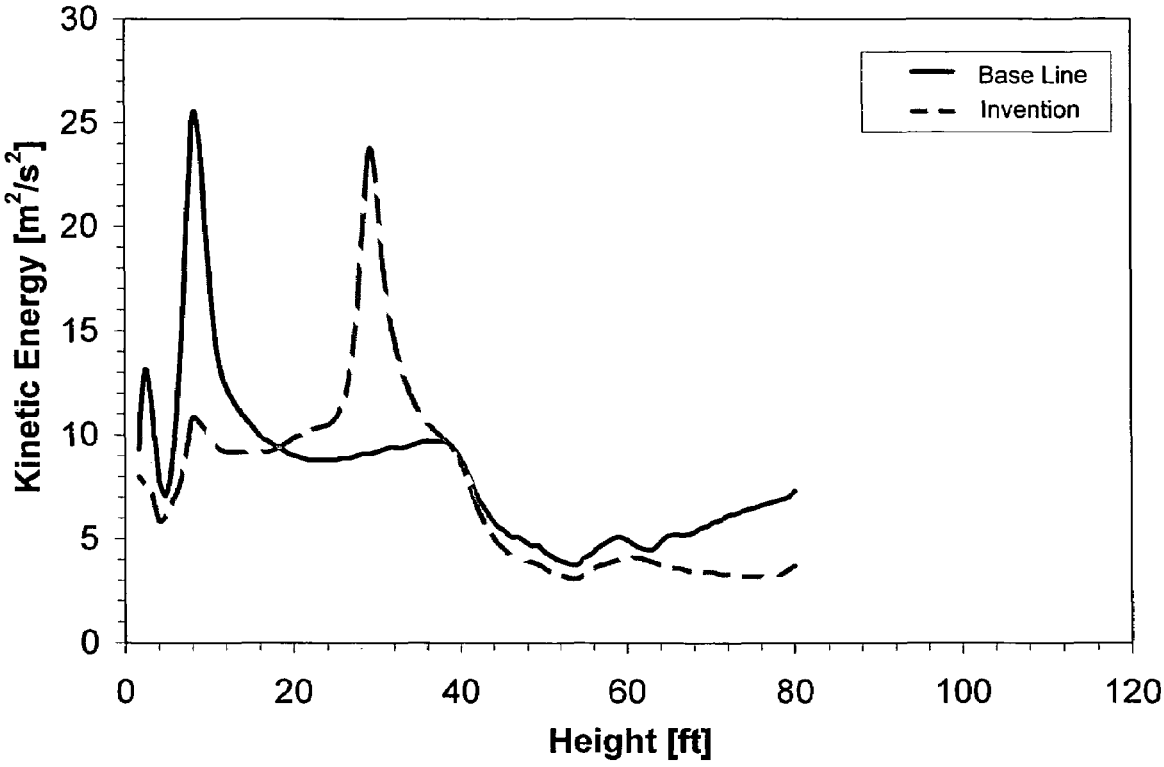
FIG. 6 is a graphical representation of the relationship of the mass weighted turbulent kinetic energy versus height for the baseline case and the present invention case.

The turbulent mixing of air jets and bed particles for both the baseline case and invention case are compared in FIG. 6. In the baseline case, a maximum turbulent kinetic energy appears in the dense bed in the lower furnace caused by the secondary air injection. However, this highest turbulent rapidly diminishes as these jets penetrate into and mix in the furnace. In the invention case, the peak kinetic energy is located well about the dense bed, which allows for significant penetration and mixing.

Turbulence is dissipated into the bulk flow through eddy dissipation. That is, large amount of kinetic energy results in better mixing between the high velocity air and the flue gas. While in the baseline case, the high turbulence in the bottom bed is important for dense particle mixing, the upper furnace high turbulence as shown in the invention case significant improves the mixing between solid particles and flue gas. This is one of the main reasons for the reduced CO, more evenly distributed $O_2$, and enhanced heat transfer observed in the invention case.

The mechanisms for reduction of $SO_2$ and other chemical species by limestone reaction through mixing have been discussed above. However, the calculated results achieved were better than would be expected. The use of deep staging in the primary stage reduces the magnitude of the gas channels formed in the primary stage in and of itself. The addition of high-velocity air nozzles above the dense bed destroys any channels that are formed and causes the collapse of the channel below it. Therefore, the combination of staging and asymmetric opposed high-velocity air nozzles above the dense bed produced surprising results.

The enhanced mixing achieved using the present invention is predicted to reduce the stoichiometric ratio of Ca/S in the CFB from ~3.0 to ~2.4, while achieving the same level of $SO_2$ reduction (92%). The reduction in Ca/S corresponds to reduced limestone required to operate the boiler and meet $SO_2$ regulations. Since limestone for CFB units often costs more than the fuel (coal or gob), this is a significant reduction on the operational budget for a CFB plant.

Certain modifications and improvements will occur to those skilled in the art upon a reading of the foregoing description. By way of example, secondary air ports could be installed inline and only some of the secondary air injection ports may operate at any given time. Alternatively, all of the secondary air injection ports may be run, with only some of the air ports running at full capacity. It should be understood that all such modifications and improvements have been deleted herein for the sake of conciseness and readability but are properly within the scope of the following claims.

We claim:

1. A circulating fluidized bed boiler having improved reactant utilization, the circulating fluidized bed boiler comprising:

(a) a circulating fluidized bed including:
  (i) a dense bed portion;
  (ii) a lower furnace portion adjacent to the dense bed portion; and
  (iii) an upper furnace portion;

(b) a reactant to reduce the emission of at least one combustion product in the flue gas; and (c) a plurality of secondary air injection ports downstream of the circulating fluidized bed for providing mixing of the reactant and the flue gas in the furnace above the dense bed, wherein:
  i. the secondary air injection ports are positioned at a height in the furnace where the gas and particle density is less than about 165% of the furnace exit gas and particle density; and
  ii. the amount of reactant required for the reduction of the emission of the combustion product is reduced.

2. The apparatus according to claim 1, further including a return system for returning carry over particles from the flue gas to the circulating fluidized bed.

3. The apparatus according to claim 2, wherein the return system includes a separator for removing the carry over particles from the flue gas.

4. The apparatus according to claim 3, wherein the separator is a cyclone separator.

5. The apparatus according to claim 3, further including a fines collector downstream from the separator.

6. The apparatus according to claim 5, wherein the fines collector is a bag house.

7. The apparatus according to claim 5, wherein the fines collector is an electrostatic precipitator.

8. The apparatus according to claim 1, wherein the reactant is selected from the group consisting of caustic, lime, limestone, fly ash, magnesium oxide, soda ash, sodium bicarbonate, sodium carbonate, double alkali, sodium alkali, and the calcite mineral group which includes calcite (CaCO3), gaspeite ({Ni, Mg, Fe}CO3), magnesite (MgCO3), otavite (CdCO3), rhodochrosite (MnCO3), siderite (FeCO3), smithsonite (ZnCO3), sphaerocobaltite (CoCO3), and mixtures thereof.

9. The apparatus according to claim 8, wherein the reactant is limestone.

10. A circulating fluidized bed boiler having improved reactant utilization, the circulating fluidized bed boiler comprising:

(a) a circulating fluidized bed including a dense bed portion, a lower furnace portion adjacent to the dense bed portion, and an upper furnace portion, wherein the dense bed portion of the circulating fluidized bed boiler is maintained below the stoichiometric ratio (fuel rich stage) and the lower furnace portion is maintained above the stoichiometric ratio (fuel lean stage), thereby reducing the formation of NOx;

(b) a reactant to reduce the emission of at least one combustion product in the flue gas; and (c) a plurality of secondary air injection ports downstream of the circulating fluidized bed for providing mixing of the reactant and the flue gas in the furnace above the dense bed, wherein:
  i. the secondary air injection ports are positioned at a height in the furnace where the gas and particle density is less than about 165% of the furnace exit gas and particle density; and ii. the amount of reactant required for the reduction of the emission of the combustion product is reduced.

11. The apparatus according to claim 10, wherein the secondary air injection ports are located in the lower furnace portion of the circulating fluidized bed boiler.

12. The apparatus according to claim 11, wherein the secondary air injection ports are asymmetrically positioned with respect to one another.

13. The apparatus according to claim 12, wherein the secondary air injection ports are arranged in a way selected from the group consisting of opposed inline, opposed staggered, and combinations thereof.

14. The apparatus according to claim 10, wherein the secondary air injection ports are positioned between about 10 feet and 30 feet above the dense bed.

15. The apparatus according to claim 10, wherein the secondary air injection ports are positioned at a height in the furnace wherein the ratio of the exit column density to the density of the dense bed top is greater than about 0.6.

16. The apparatus according to claim 10, wherein the jet penetration of each secondary air injection port, when unopposed, is greater than about 50% of the furnace width.

17. The apparatus according to claim 10, wherein the jet penetration is greater than about 15 inches of water above the furnace pressure.

18. The apparatus according to claim 17, wherein the jet penetration is between about 15 inches and 40 inches of water above the furnace pressure.

19. The apparatus according to claim 10, wherein the secondary air injection ports deliver between about 10% and 35% of the total air flow to the boiler.

20. A circulating fluidized bed boiler having improved reactant utilization, the circulating fluidized bed boiler comprising:

(a) a circulating fluidized bed including (i) a dense bed portion;

(ii) a lower furnace portion adjacent to the dense bed portion; and (iii) an upper furnace portion, wherein the dense bed portion of the circulating fluidized bed boiler is maintained below the stoichiometric ratio (fuel rich stage) and the lower furnace portion is maintained above the stoichiometric ratio (fuel lean stage), thereby reducing the formation of NOx;

(b) a reactant to reduce the emission of at least one combustion product in the flue gas;

(c) a plurality of secondary air injection ports downstream of the circulating fluidized bed for providing mixing of the reactant and the flue gas in the furnace above the dense bed, wherein:

i. the secondary air injection ports are positioned at a height in the furnace where the gas and particle density is less than about 165% of the furnace exit gas and particle density; and ii. the amount of reactant required for the reduction of the emission of the combustion product is reduced; and (d) a return system for returning carry over particles from the flue gas to the circulating fluidized bed.

21. The apparatus according to claim 20, wherein the return system includes a separator for removing the carry over particles from the flue gas.

22. The apparatus according to claim 21, wherein the separator is a cyclone separator.

23. The apparatus according to claim 21, further including a fines collector downstream from the separator.

24. The apparatus according to claim 23, wherein the fines collector is a bag house.

25. The apparatus according to claim 23, wherein the fines collector is an electrostatic precipitator.

26. The apparatus according to claim 20, wherein the reactant is selected from the group consisting of caustic, lime, limestone, fly ash, magnesium oxide, soda ash, sodium bicarbonate, sodium carbonate, double alkali, sodium alkali, and the calcite mineral group which includes calcite (CaCO3), gaspeite ({Ni, Mg, Fe}CO3), magnesite (MgCO3), otavite (CdCO3), rhodochrosite (MnCO3), siderite (FeCO3), smithsonite (ZnCO3), sphaerocobaltite (CoCO3), and mixtures thereof.

27. The apparatus according to claim 26, wherein the reactant is limestone.

28. The apparatus according to claim 20, wherein the secondary air injection ports are located in the lower furnace portion of the circulating fluidized bed boiler.

29. The apparatus according to claim 28, wherein the secondary air injection ports are asymmetrically positioned with respect to one another.

30. The apparatus according to claim 29, wherein the secondary air injection ports are arranged in a way selected from the group consisting of opposed inline, opposed staggered, and combinations thereof.

31. The apparatus according to claim 20, wherein the secondary air injection ports are positioned between about 10 feet and 30 feet above the dense bed.

32. The apparatus according to claim 20, wherein the secondary air injection ports are positioned at a height in the furnace wherein the ratio of the exit column density to the density of the dense bed top is greater than about 0.6.

33. The apparatus according to claim 20, wherein the jet penetration of each secondary air injection port, when unopposed, is greater than about 50% of the furnace width.

34. The apparatus according to claim 20, wherein the jet penetration is greater than about 15 inches of water above the furnace pressure.

35. The apparatus according to claim 34, wherein the jet penetration is between about 15 inches and 40 inches of water above the furnace pressure.

36. The apparatus according to claim 20, wherein the secondary air injection ports deliver between about 10% and 35% of the total air flow to the boiler.

* * * * *

UNITED STATES PATENT AND TRADEMARK OFFICE

CERTIFICATE OF CORRECTION

PATENT NO. : 7,410,356 B2
APPLICATION NO. : 11/281915
DATED : August 12, 2008
INVENTOR(S) : Higgins et al.

It is certified that error appears in the above-identified patent and that said Letters Patent is hereby corrected as shown below:

In Column 2, Line 24, "Sphaerocobaltite (COCO2)" should be
--Sphaerocobaltite (CoCO2)--

Signed and Sealed this

Seventh Day of October, 2008

JON W. DUDAS
*Director of the United States Patent and Trademark Office*